United States Patent [19]

Vadala'

[11] Patent Number: 4,742,660

[45] Date of Patent: May 10, 1988

[54] HIGHLY SOUND INSULATING HOLLOW CLAY TILE FOR THE CONSTRUCTION OF FLOORS

[76] Inventor: Giuseppe Vadala', Via Giovanni XXIII, 4-Roggiano Gravina, Italy

[21] Appl. No.: 885,972

[22] Filed: Jul. 15, 1986

[30] Foreign Application Priority Data

Jul. 24, 1985 [IT] Italy ..... 48403 A/85

[51] Int. Cl.[4] ..... E04B 5/04; E04C 2/04

[52] U.S. Cl. ..... 52/606; 52/322; 52/434; 52/441

[58] Field of Search ..... 52/321, 323, 324, 440, 52/441, 503, 504, 606, 434, 322

[56] References Cited

FOREIGN PATENT DOCUMENTS

| | | | |
|---|---|---|---|
| 1534867 | 9/1969 | Fed. Rep. of Germany | 52/321 |
| 2640064 | 3/1977 | Fed. Rep. of Germany | 52/606 |
| 66212 | 3/1956 | France | 52/606 |
| 2359257 | 2/1978 | France | 52/323 |
| 463966 | 6/1951 | Italy | 52/324 |
| 465097 | 8/1951 | Italy | 52/606 |
| 500319 | 11/1954 | Italy | 52/324 |
| 503994 | 12/1954 | Italy | 52/434 |
| 549146 | 10/1956 | Italy | 52/324 |
| 591966 | 4/1959 | Italy | 52/440 |
| 645119 | 9/1962 | Italy | 52/322 |

*Primary Examiner*—Alfred C. Perham

*Attorney, Agent, or Firm*—Townsend and Townsend

[57] ABSTRACT

A highly sound insulating clay tile for the construction of floors has an outer substantially parallelepiped shape with symmetrical, laterally projecting portions for the support of each tile by reinforced concrete floor beams. Each tile comprises a peripheral wall having a substantially uniform thickness. Extending from this peripheral wall toward the inside of the tile are a plurality of very short vertical and horizontal partitions. The plurality of horizontal and vertical partitions are combined with other horizontal and obliquely inclined partitions for defining two main longitudinal cavities having a polygonal or circular cross section. The main cavities are symmetrically positioned with respect to a vertical center plane, and the cross-sectional area of the main cavities comprises a major portion of the cross-sectional area of each tile.

5 Claims, 1 Drawing Sheet

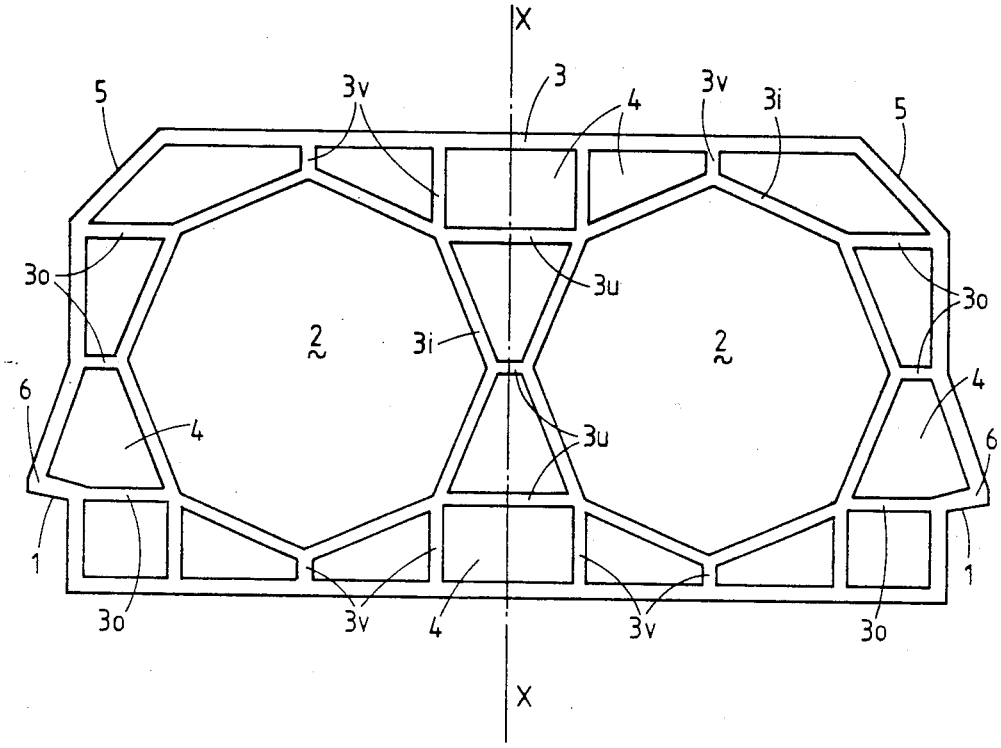
X
3
5
3v
4
3v
3i
5
3o
3u
3o
2
3i
2
6
4
4
3u
6
1
1
3o
3v
4
3v
3o
X

HIGHLY SOUND INSULATING HOLLOW CLAY TILE FOR THE CONSTRUCTION OF FLOORS

BACKGROUND OF THE INVENTION

1. Field of the Invention

The invention relates to a hollow tile for the construction of floors, the floor being made of a combination of tiles and prefabricated, reinforced concrete beams. The tiles have a high capacity for sound insulation, are light in weight, and exhibit high mechanical strength. The tiles are particularly suitable for use in the construction of floors of residential buildings and for industrial construction in general. The installation of a floor using the tiles according to the present invention is carried out by interposing the tile between prefabricated, parallel-spaced beams of reinforced concrete which form the floor-carrying structure. Afterward, a concrete filling takes place for providing the necessary cohesion to the components of the structure.

2. Description of the Relevant Art

Conventional clay blocks or tiles for the construction of floors have a hollow inner structure, e.g., they include a plurality of cavities having a rectangular cross section defined by inner partition walls perpendicular to each other and parallel to the main side surfaces of the tile. The cavities serve to decrease the floor weight and further provide sound and thermal insulation due to the motionless air contained in the cavities. The sound insulation of a floor represents a very important problem since, in general, there are many different sources of external sound. In the case of residential buildings, sources of sound include noises produced in adjacent apartments or rooms, noises arising from the operation of sanitary equipment and the like within the building, and noises arising from the widespread use of household electrical equipment and appliances. When noises are radiated directly in the air (airborne noises), the noises can pass through the floors according to two different paths, i.e., (a) the noise may pass through the air from the source thereof up to the partition wall separating the disturbing room and the disturbed room, and then the noise passes through the partition wall and into the air in the disturbed room; and (b) the partition wall, which is hit by the sound waves, begins to vibrate. The wall may have a number of its own resonant frequencies so that, everytime a frequency of the incident sound waves is at or near one of the resonant frequencies of the partition walls, the flexural vibrations of the wall increase, and the wall then acts as a secondary noise source for irradiating a portion of the received sound energy into the room.

According to the weight law, acoustical disturbances of a homogeneous partition wall increase as the weight of the partition wall increases. This is especially true at low frequencies. Accordingly, the problem to be solved is to construct a lighter, but more complex, structure than that of a simple homogeneous wall (so as not to follow the aforementioned weight law) for providing good sound insulation. Such structures must be based on the artifice of introducing discontinuities into the partition wall and by constructing the wall with heterogeneous materials.

SUMMARY OF THE INVENTION

An object of the present invention is to provide a hollow clay tile or block having an inner geometry which improves the sound insulating capacity of the tile, as compared with that of conventional tiles or blocks. The invention meets this objective by providing a hollow tile for the construction of floors, the tile having an outer substantially parallelepiped shape, rectangular in cross section, and having two laterally symmetrical protrusions adapted to be supported by a plurality of parallel, prefabricated, reinforced concrete beams which form the carrying structure of the floor. The hollow tile or block has a continuous clay peripheral wall extending along the entire outer perimeter. Extending from said peripheral wall and inwardly into the tile are a plurality of very short vertical and horizontal partitions, which define a plurality of longitudinal small cavities of various shapes and dimensions. The small cavities, in turn, encircle two main longitudinal cavities having a greater volume than the small cavities. The cross sectional area of the main cavities occupy the majority of the cross-sectional area of the block or tile. The main cavities may have cross sections representing any polygonal shape.

The inner structure described requires a very small amount of clay. Consequently, a floor constructed with such tiles is lighter than floors constructed with conventional blocks or tiles. In particular, floors constructed using tiles according to the present invention weigh about 15–30 kg/m$^2$ less than a floor constructed with conventional blocks or tiles.

BRIEF DESCRIPTION OF THE DRAWING

These and other characteristics and advantages of the present invention will be better understood by reading the following description, reference being made to the accompanying drawing, which shows a cross section of a preferred embodiment of a tile or block in accordance with the present invention.

DETAILED DESCRIPTION OF THE PREFERRED EMBODIMENT

In the FIGURE, a hollow block or tile is shown having a substantially rectangular cross-section. The hollow block or tile comprises a thin peripheral wall 3 having a substantially uniform thickness. Peripheral wall 3 has upper beveled corners 5 and symmetrical, laterally extending projecting parts 6 near the lower extremity of each side. The lower portions of projecting parts 6 form shoulders 1 for resting on the longitudinal flanges of the carrying structure of the floor. The carrying structure of the floor preferably comprises prefabricated, prestressed beams made of reinforced concrete placed adjacent to the blocks or tiles. Extending from the horizontal and substantially vertical portions of the periperal wall 3, and towards the interior of the block or tile, are a plurality of short, longitudinal, vertical partitions **3*v* and longitudinal, horizontal partitions 3*o*. Vertical partitions 3*v* and horizontal partitions 3*o* combine with longitudinal, inner, obilquely inclined partitions 3*i* and longitudinal, inner, horizontal partitions 3*u* for defining therebetween a plurality of small longitudinal cavities 4 having various shapes and dimensions. The combined partitions 3*v*, 3*o*, 3*i*, and 3*u* also define two longitudinal main cavities 2 having a polygonal, e.g., octagonal, cross section. Main cavities 2** have a cross-sectional area as large as possible, and they are symmetrically positioned with respect to a longitudinal, vertical, center plane X-X of the hollow tile.

It is well known in the art that when a propagating sound wave impinges against the interface between two media, a first part of the incident energy is reflected by the second medium and sent back, another part passes through the second medium (if the second medium has a finite thickness), and a further third part is absorbed by the second medium. Therefore, for each wall, three coefficients can be defined: (1) the feedback coefficient, i.e., the ratio between the fedback energy and the incident energy; (2) the transparent coefficient, i.e., the ratio between the energy that passes through the wall and the incident energy; and (3) the absorption coefficient, i.e., the ratio between the energy which the wall has absorbed and the incident energy. The feedback coefficient is a function of the ratio between the characteristic sound impedence of the two media. The characteristic sound impedence of a medium is the parameter given by the product GC of the density G of the medium and the rate of propagation C of the sound into said medium. Thus, the feedback coefficient is higher when the characteristic sound impedences of the two media differ greatly from each other. In the case of air in ordinary conditions of temperature and pressure, $GC=410\ kg/m^2s$. In condensed media and in solids, the values of the characteristic impedence are much higher, indicating greater density and sound propagation rate.

In the disclosed embodiment, the clay used to form the tile has a characteristic sound impedence which is about $10^4$ times higher than that of air. Thus, the majority of an impinging sound wave is sent back as it encounters the successive air and clay layers. In addition to the sound insulating effect, the main cavities 2 effect a drastic reduction in the share of transmitted sound energy. This is especially true for the structure having octagonal main cavities 2. As the sound wave impinges against the tile, the outer wall of the tile is deformed under the effect of the pressure stress. As the wave propagates, it encounters the inner wall formed by partitions **3*i*, which define each octagonal cavity 2. Partitions 3*i* form walls which are longer, and therefore broader, than the preceding wall. Consequently, the surfaces of partitions 3*i* cause a reduction of the amplitude of the original deformation, and therefore the sound pressure level decreases. Thus, the particular geometrical form of a tile according to the present invention further reduces the pressure wavefront when the wave impinges upon the inside of the main cavities 2** (the cavities being octagonal in this case).

The geometrical inner form of the tile according to the present invention also provides remarkable thermoinsulating characteristics. The two broad prismatic longitudinal cavities 2 enable turbulent circulation of the air contained therein. It is well known that such turbulent circulation has convection thermal exchange coefficients higher than those associated with motionless air. At the same time, there is a drastic reduction of heat flux for conduction in the tile, the reduction being even higher than the increase of the conductivity from air to clay. In fact, due to the low thermal conductivity of air, the large cavities 2 cause the clay partitions to become the preferred paths for the heat flux, and the heat flux is conducted through the end portions of the tile or block. It is evident that the thicker the partitions **3*v*, 3*u*, and 3*o*** and the longer the path, the more the heat flux will be hindered.

When the mechanical strength of the tile according to the invention is considered, the symmetrical structure of the tile partitions, with respect to the plane X—X, causes all the thrust and compression stresses to be perfectly balanced by the corresponding resultants of the reaction forces.

It must be noted that the two main cavities 2 may be transversely separated from one another by a central partition, or they could also be connected to each other in such a way that two sides of one of the cavities, which are placed in proximity to the plane X—X, may constitute the extensions of two corresponding sides of the other cavity 2. Additionally, the large inner longitudinal cavities 2, instead of having an octagonal cross section, could have any polygon as a cross section or, if desired, a circular cross section. To form cavities 2 with a circular cross section, it is sufficient to substitute the chords of the polygonal cross section of the cavities with circular arches. Such circular arches are longer than the reflective cords of a polygonal structure, but they have the same center angle. As a result of the longer arches, a greater amount of clay will be needed to form the tile, and the tile, as well as the floor, will be heavier. Furthermore, during the manufacturing process, when the material is still "green" (wet), the circular arches may be inadvertently deformed and, therefore, the sound insulating properties and strength of the tile may be compromised. The possibility of deformation could be avoided by increasing the thickness of the cylindrical arches and of the anchoring partitions, but that prejudices the lightness of the tile. For these reasons, a tile having main cavities 2 with an octagonal cross section is preferable, since that permits the use of very thin partitions for increasing the lightness of the tile without prejudicing the solidity and high compression strength of the tile.

The tile or block according to the invention may be constructed with heights from 12–30 cm, but the octagons which form the cross section of the cavities 2 are regular octagons only when the height of the tile is equal to 20 cm, since it is advisable to obtain cavities of the maximum radius in order to obtain a tile as lightweight as possible. In the case of tiles with heights lower than 20 cm, and installed with a center distance of 30 cm (where "center distance" means the distance in transversal direction between center lines of two successive tiles installed at each longitudinal side of a carrying beam), the octagons which constitute the cross section of the cavities 2 will have an elongated shape in the transversal direction of the tile. (Thus, tiles having circular cross sections would have eliptical cross sections). In the case of tiles having heights greater than 20 cm, the octagons forming the cross section of the cavities 2 will have an elongated shape in the direction of the plane X—X. For heights greater than 25 cm, it is advisable to construct prismatic cavities 2 having more than 8 sides or faces.

What is claimed is:

1. A highly sound insulating hollow clay tile for the construction of floors, the tile having a parallelepiped outer shape of a substantially rectangular cross section with lateral symmetrically projection portions (1,6) for the connection of each tile with the adjacent carrying beams of a floor made of reinforced concrete, said tile further having a peripheral wall (3) of a substantially uniform thickness, said peripheral wall (3) comprising upper and lower horizontal wall elements from which extend towards the inside of the tile a plurality of very short vertical partition walls (**3*v*) and vertical wall elements from which extend towards the inside of the tile a plurality of horizontal partition walls (3*c***) of very short length, which cooperate to define therebetween a plurality of small sound insulating polygonal cavities (4) of different form and dimension, and, which in combination with other inner inclined longitudinal partitions (3*a*) and with other horizontal partitions (3*u*), defined two large main longitudinal cavities (2), symmetric with respect of a longitudinal vertical center plane (x—x) of each tile, said main cavities (2) occupying the most part of the cross section of the tile, and being thus entirely separated from one another, as well as from the outside by a series of the small sound insulating cavities (4).

2. A tile according to claim 1, wherein the cross section of each main cavity (2) is circular so that the partitions (3*i*) encircling each cavity are shaped as archs of a same circumference.

3. A tile according to claim 1, wherein with reference to a constant transversal width of the tile, the hollow tiles have greater or smaller heights according to the thickness of the floor, the height of the the main cavities (2) increasing as the tile height increases and respectively decreasing as the height of the tile decreases, so that the main cavities (2) will have accordingly a vertically elongated or shortened cross section.

4. A sound insulating hollow clay tile for the construction of floors comprising:

a generally straight peripheral wall having a uniform thickness and forming a parallelepiped outer shape of a substantially rectangular cross section, the wall having straight portions (1,6) laterally projecting at discrete angles from the wall for forming a hollow shoulder for the connection of each tile with an adjacent carrying beam of the floor;

a plurality of short, straight vertical partitions (3*v*) extending from horizontal portions of the peripheral wall and toward the inside of the tile;

a plurality of short, straight horizontal partitions (3*o*) extending from vertical portions of the peripheral wall and toward the inside of the tile;

a plurality of straight inclined partitions (3*i*) connected to the horizontal and vertical partitions for forming first and second polygonal main cavities symmetric with respect to a longitudinal center plane (x—x) of each tile and for forming a plurality of smaller cavities completely surrounding each main cavity, each vertical, horizontal, or inclined partition wall being connected to an adjacent vertical, horizontal, or inclined partition wall at a discrete angle.

5. The tile according to claim 4 further comprising a horizontal inner partition (3*u*) disposed between the first and second main cavities and connected at a discrete angle to an inclined partition of each main cavity.

* * * * *